US005819558A

United States Patent [19]

Takegawa et al.

[11] Patent Number: 5,819,558

[45] Date of Patent: Oct. 13, 1998

[54] METHOD OF LOWERING THE YARN HEIGHT FOR KNITTING SINGLE KNIT FABRIC

[75] Inventors: Yujiro Takegawa; Mitsunobu Futakuchi; Nobuhisa Shu, all of Ishikawa-ken, Japan

[73] Assignee: Tsudakoma Kogyo Kabushiki Kaisha, Japan

[21] Appl. No.: 680,177

[22] Filed: Jul. 15, 1996

[30] Foreign Application Priority Data

Jul. 17, 1995 [JP] Japan ..... 7-201796

[51] Int. Cl.[6] ..... D04B 1/00; D04B 1/10

[52] U.S. Cl. ..... 66/64; 66/61

[58] Field of Search ..... 66/60 R, 61, 64

[56] References Cited

U.S. PATENT DOCUMENTS

| | | | |
|---|---|---|---|
| 782,480 | 2/1905 | Benndorf | 66/61 |
| 4,768,357 | 9/1988 | Ohtake . | |
| 5,557,948 | 9/1996 | Shima et al. | 66/64 |

FOREIGN PATENT DOCUMENTS

| | | | |
|---|---|---|---|
| 164487 | 12/1985 | European Pat. Off. . | |
| 679747 | 11/1995 | European Pat. Off. . | |
| 170545 | 9/1904 | Germany | 66/61 |
| 2636357 | 2/1978 | Germany . | |
| 1012855 | 7/1987 | Japan . | |
| 21660 | 10/1903 | United Kingdom | 66/61 |
| 27730 | 2/1904 | United Kingdom | 66/61 |

*Primary Examiner*—John J. Calvert

*Attorney, Agent, or Firm*—Webb Ziesenheim Bruening Logsdon Orkin & Hanson, P.C.

[57] ABSTRACT

A method of knitting a single knit fabric comprising the steps of successively advancing a plurality of needles corresponding to a non-knitting section within which a yarn from a yarn feeder forms a transit yarn portion beginning with a needle on the side of a starting point of the transit yarn portion to lower the yarn from the yarn feeder below the needles, and engaging the yarn from the yarn feeder by another needle on the side of the yarn feeder closer to the yarn feeder than the advanced needles.

7 Claims, 13 Drawing Sheets

FIG.2(B)

$24_1$
Wb
Wa
$24_2$
20b
20a
22b
22

20b
20a
22b
22a 20b
20a
22a
22b
L 20b
20a
22a
22b
$P_{61}$ 20b
20a
22a
22b 20b
20a
20c
22c

METHOD OF LOWERING THE YARN HEIGHT FOR KNITTING SINGLE KNIT FABRIC

BACKGROUND OF THE INVENTION

1. Field of the Invention

This invention relates to a method of knitting a single knit fabric on which a transit yarn portion appears such as an intarsia knit fabric.

2. Prior Art

In a multicolor single knit fabric, such as an intarsia knit fabric, two kinds of sections are present in the same course. One section is a knitting section in which a particular yarn is knitted. Another section is a non-knitting section in which another yarn is knitted. If the non-knitting section is present between a starting point of the particular yarn and the knitting section, the particular yarn supplied forms a transit yarn portion, i.e., crossover yarn portion, in the non-knitting section.

In knitting a multicolor single knit fabric, as described above, a yarn carrier (i.e. yarn feeder), a transit yarn is fed to a knitting section past a non-knitting section. Occasionally, the transit yarn portion becomes so high relative to the needles corresponding to the knitting section that the yarn from the yarn feeder is not caught and is not knitted by the needles in the knitting section. The yarn extending to the yarn feeder from a start point at an end of a knitting section (see FIG. 2(B)) or at a boundary between the non-knitting section and a knitting section preceding the non-knitting section (see FIG. 2(A)) gradually rises from the starting point side toward the yarn feeder side until it becomes so high that the yarn is not readily caught by an advanced needle at a front end portion of another knitting section (at the end on the upstream side in the moving direction of the yarn feeder).

In one method of ensuring that a transit yarn portion is caught by a needle corresponding to a knitting section, an intermediate portion of the transit yarn portion is caught at one or more locations by several needles in a non-knitting section. The transit yarn portion is knitted in a ground knit portion knitted together with another yarn, creating a so-called tuck stitch to fix the intermediate portion of the transit yarn portion at the one or more locations to the knit fabric and thereby lower the yarn. With this method, however, after the ground knit portion (including the transit yarn portions) is delivered from a take-up apparatus (or after complete knitting of the fabric), the transit yarn portions knitted in tuck stitches must be cut and removed from the ground knit portion. This cutting and removal operation is cumbersome. Furthermore, the color of the transit yarn portion knitted in the ground knit portion remains in the ground design which deteriorates the quality.

It is the object of the present invention to ensure that a transit yarn portion is caught by needles in a knitting section next to a non-knitting section without complicating the: operation or deteriorating the fabric quality.

SUMMARY OF THE INVENTION

The present invention is a method of knitting a single knit fabric in which a yarn from a yarn feeder is not knitted but forms a transit yarn portion. The method includes the steps of successively advancing a plurality of needles corresponding to a non-knitting section within which the yarn forms the transit yarn portion beginning with a needle on the side of a start point of the transit yarn portion. The yarn from the yarn feeder is lowered below the needles. The yarn from the yarn feeder is engaged by another needle closer to the yarn feeder than the advanced needles.

When a plurality of needles corresponding to a non-knitting section are successively advanced beginning with a needle nearest to a start point of the crossover yarn segment, the transit yarn portion is engaged with an arcuate face at a front end of one of the advanced needles so that it is guided to the lower face of the needle. Consequently, the transit yarn portion extending from the start point toward the yarn feeder is lowered at the location of the needle, and it is held low by the next needle advanced. As a result, the transit yarn portion is caught with certainty by needles in the knitting section.

As described above, according to the present invention, the yarn from the yarn feeder, having moved to the knitting section past the non-knitting section, can be caught with certainty by the needles in the knitting section. Also, since the transit yarn portion is not knitted in the ground knit portion, it can be removed simply by cutting the transit yarn portion, thus avoiding quality deterioration.

The needles which are successively advanced may be selected from needles of a needle bed which takes part in knitting and/or needles of another needle bed which does not take part in knitting. The needles which are successively advanced may be selected from all the needles corresponding to the non-knitting section or a plurality of those needles or a plurality of needles opposite the knitting needles from the start point of the transit yarn portion. The other needle may be the first needle of a knitting section or the last needle in the non-knitting section.

DETAILED DESCRIPTION OF THE PREFERRED EMBODIMENTS

The knitting machine used to perform the present invention is preferably a carriageless flat-knitting machine which does not include a carriage for cams for moving a plurality of needles back and forth. A carriageless flat-knitting machine moves a plurality of needles back and forth individually by means of actuators such as linear motors. In ordinary knitting, a plurality of needles are individually moved back and forth in synchronism with a movement of a yarn carrier, i.e., a yarn feeder. One such carriageless flat-knitting machine is disclosed in the Official Gazette of Japanese Patent Application Publication No. Hei 1-12855.

Figure 1:
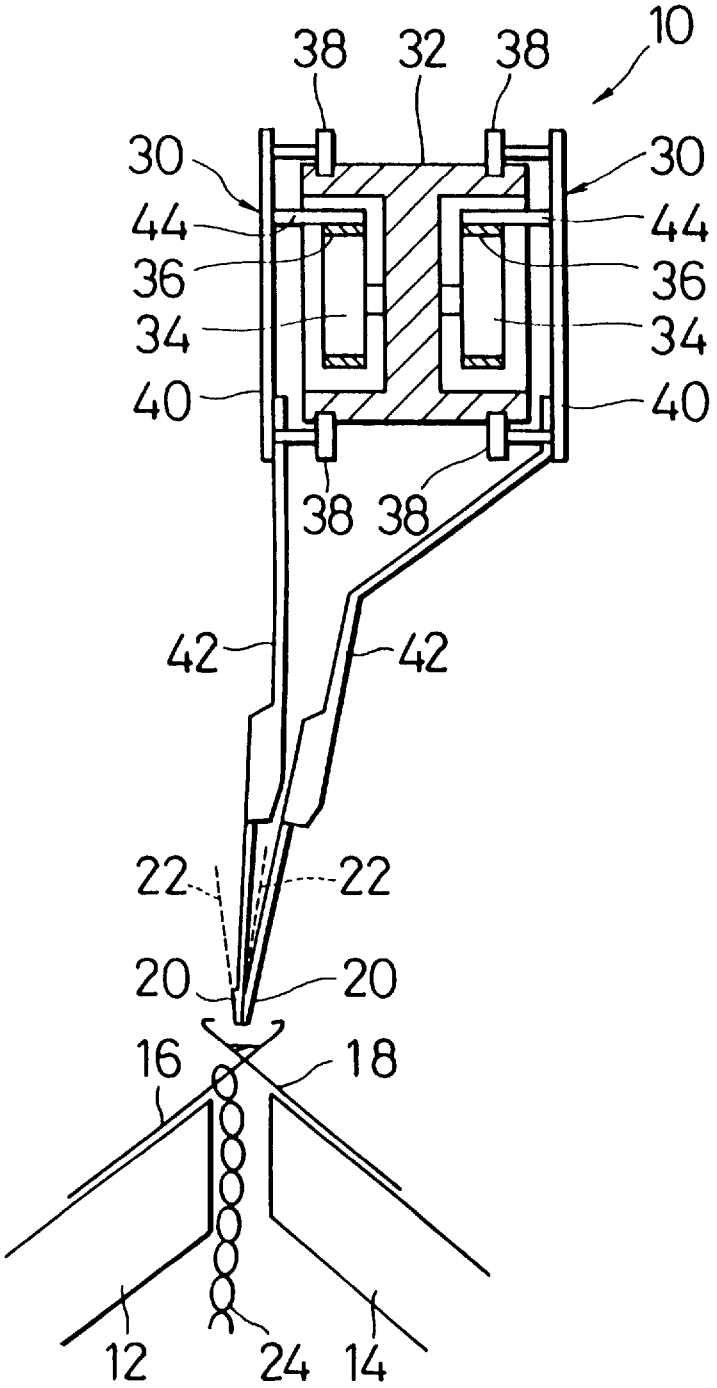
FIG. 1 is a schematic side elevational view showing needles, yarn feeders and yarn supply units of a flat-knitting machine.

Referring to FIGS. 1 and 2, a carriageless flat-knitting machine 10 includes two needle beds 12 and 14 disposed in an inverted V-shaped configuration in order to knit a multicolor single knit fabric, a plurality of needles 16 and 18 arranged in parallel to each other on the needle beds 12 and 14, respectively, and a plurality of yarn feeders, i.e., yarn carriers 20, each having one or more yarn guide holes.

The needles 16 on the front side and the needles 18 on the rear side intersect with each other at front end portions thereof when they are advanced. Each of the needles 16 and 18 is moved back and forth in a predetermined pattern based on a predetermined knitting plan in synchronism with a movement of a yarn feeder 20 by an actuator or preferably a linear motor. The pattern of the back and forth movement of each needle can be represented in a chart wherein the axis of ordinate is represented by the amount of movement of the needle with respect to the position of zero given by the position of the knocking-over edge and the axis of abscissa is represented by the amount of movement of the yarn feeder or the time. Such a pattern is called a wave pattern, knit pattern, needle movement pattern and so forth.

Knitting yarns 22 of different types are threaded through the individual yarn feeders 20. Each of the yarn feeders 20 is reciprocated transversely above intersecting locations of the needles 16 and 18 by a yarn supply unit 30 so that it supplies the knitting yarn from above to the intersecting portions of the needles 16 and 18. The movement of each of the yarn feeders 20 is set based on the predetermined knitting plan.

The yarn supply units 30 are supported for reciprocating motion in a longitudinal direction of and on a common rail 32 assembled to a frame of the knitting machine which extends transversely with respect to the frame. A driving mechanism for individually moving each of the yarn supply units 30 includes a pair of pulleys 34 mounted for rotation at locations of the rail 32 spaced apart from each other in the longitudinal direction of the rail 32 and an endless belt 36 extending between the two pulleys.

Each of the yarn supply units 30 includes a traveling member 40 supported for back and forth movement in the longitudinal direction of and on the rail 32 by a plurality of rollers 38, a stay 42 extending from the traveling member 40, and a connection member 44 for connecting the traveling member 40 to the endless belt 36. The rail 32 has a pair of guide grooves for partially receiving the rollers 38. Each of the yarn feeders 20 is attached to an end portion of the stay 42 of the corresponding yarn supply unit 30. Each of the yarn supply units 30 is reciprocated transversely based on the predetermined knitting plan as the corresponding endless belt 36 is circulated reciprocally by forward and background rotations of a corresponding source of rotation (not shown).

While, in the example shown in FIG. 1, only one pair of yarn supply units 30 is shown, where the knitting machine includes three or more yarn feeders, either a plurality of pairs of yarn supply units 30 are disposed on the rail 32 or a plurality of yarn supply unit 30 assemblies on the rail 32, as shown in FIG. 1, are disposed in the leftward and rightward directions.

As shown in FIG. 1, the needles 16 on the front side principally directly contribute to knitting loops at an extreme end of a knit fabric 24 confined by the needles 16 on the front side. The loops may otherwise be confined by the needles 18 on the rear side which do not directly contribute to knitting. The actuators for driving needles and a control unit for controlling driving sources for the yarn supply units 30 will be hereinafter described in detail with reference to FIG. 14.

A single knit fabric having a transit yarn portion produced according to the present invention includes a non-knitting section. The non-knitting section is produced when a yarn 22 from a yarn feeder 20 is not knitted but forms a transit yarn portion. A plurality of needles 16 or 18 corresponding to a crossover yarn section are successively advanced beginning with a needle nearest to a start point 26 of the transit yarn portion so that the yarn 22 from the yarn feeder 20 is caught by another needle nearer to the yarn feeder 20 than the advanced needles 16 or 18.

Figure 2A:
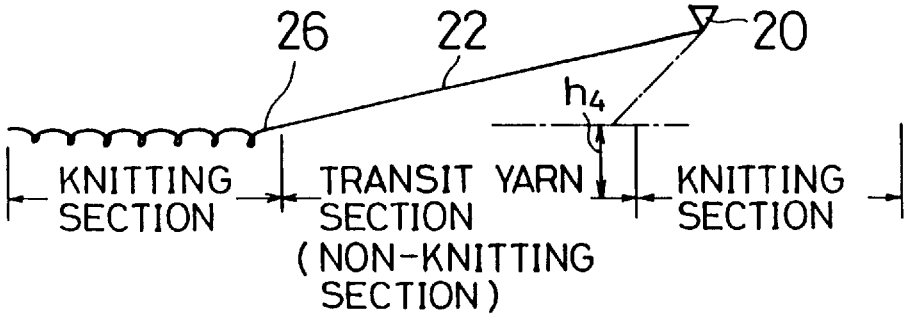
FIG. 2 is a view for explaining a transit yarn.
Figure 2B:
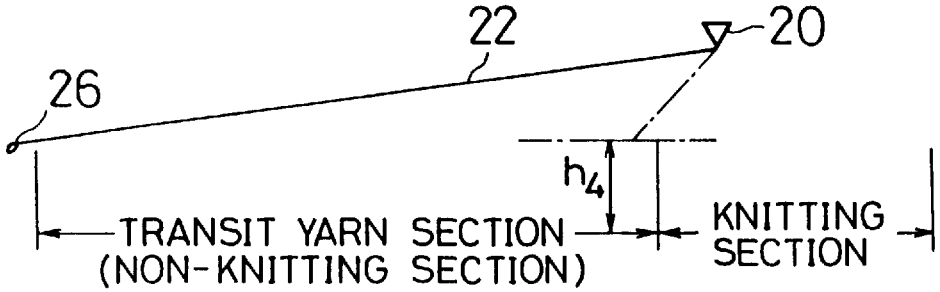
Figure 3:
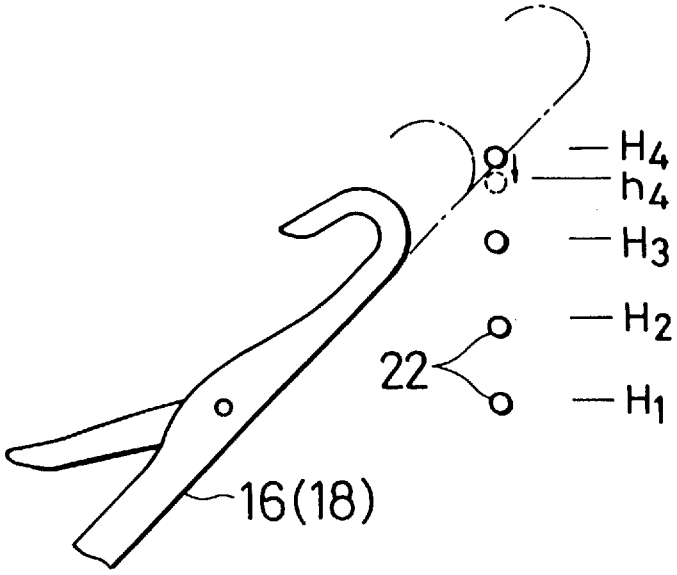
FIG. 3 is a view illustrating a relationship of the height of a transit yarn with respect to a needle.

Referring to FIGS. 2 and 3, a knitting section is at section in which a yarn 22 from a yarn feeder 20 is knit, whereas a non-knitting section is another section in which the yarn 22 is not knit but another yarn of another yarn feeder is used to knit. The yarn 22 from the yarn feeder 20 is not knitted in the non-knitting section but forms a transit yarn portion which extends across the non-knitting section.

The height H of the yarn 22 with respect to the needles 16 or 18 gradually increases to $H_1$, $H_2$, $H_3$ and $H_4$ from the side of the start point 26 of the yarn 22 toward the side of the yarn 22. Eventually, at a terminal end portion of the non-knitting section, the yarn 22 is so high that it is not readily caught by the advanced needles 16 or 18. The start point 26 of the yarn 22 is either a boundary between the non-knitting section and a knitting section preceding the non-knitting section as shown in FIG. 2(A) or an end portion of the knit fabric in its widthwise direction as shown in FIG. 2(B).

When a plurality of needles corresponding to the non-knitting section are successively advanced beginning with the needle on the side of the start point 26, the yarn is brought into contact with a front end of one of the needles and is guided while in contact with an arcuate portion of the front end of the needle to the lower face of the needle. Consequently, the height, of the yarn 22 extending from the start point 26 to the yarn feeder 20 is lowered to $H_4$ at the location of the needle. The yarn is lowered to a substantially equal height by the next advancing needle. As a result, the transit yarn portion is readily caught by the needles in the knitting section.

Figure 4A:
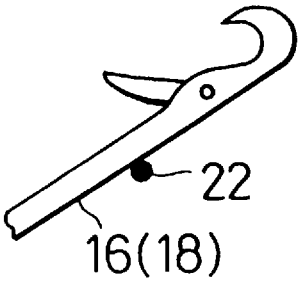
FIG. 4 is a view showing a state wherein a transit yarn is held down by a needle or needles.
Figure 4B:
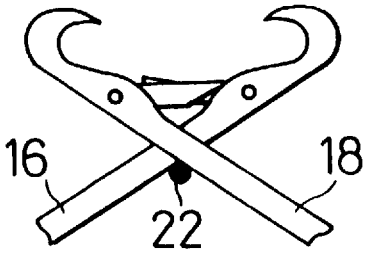

Needles on a needle bed which take part in knitting or needles on the other needle bed which do not take part in knitting may be successively advanced as shown in FIG. 4(A), or needles on both of the needle beds may be successively advanced respectively as shown in FIG. 4(B). When needles on the needle bed which take part in knitting are advanced, preferably the needles are not advanced farther than the tuck position so that loops caught by the needles do not turn over or fall and be cleared from the latches. When needles on the needle bed which do not take part in knitting are advanced, they can be advanced to the clearing position because they are empty. When needles on both of the needle beds are advanced, the distances that the needles are advanced are set in a manner as described above depending upon whether or not they take part in knitting.

When needles on only one of the needle beds are advanced, it is possible for a yarn to be pushed up together with a needle by a frictional force acting between the yarn and a front end of the needle. However, there is no such possibility when needles on both of the needle beds are advanced simultaneously. When needles on both of the needle beds are advanced, preferably the needles on the front and rear needle beds are arranged for rib knitting and all needles in the non-knitting section are successively advanced. As a result, the transit yarn portion is lowered and brought into contact with some of the needles with certainty.

The needles which are successively advanced to push down or hold down the transit yarn portion may be all the needles corresponding to the non-knitting section or a plurality of those needles. Alternatively, a plurality of needles following a plurality of the needles distal from the start point 26 of the transit yarn portion may be successively advanced. When a plurality of needles following a plurality of the needles following the start point 26 of the transit yarn portion are successively advanced, all of the needles following the plural numbered needles may be successively advanced or a portion of one of those needles may be successively advanced.

The needles which have been successively advanced to push down or hold down the transit yarn portion may be retracted at an arbitrary time after the transit yarn portion is engaged with a predetermined needle nearer to the yarn feeder 20 than the successively advanced needles. The predetermined needle may be the last needle in the non-knitting section or the first needle in the following knitting section. Alternatively, the needles pushing down the transit yarn portion may be successively retracted in the same order as they were advanced. In that case, at least the needle which was advanced last, preferably, a plurality of needles which were advanced last, is not retracted until after the transit yarn portion is engaged with the predetermined needle.

The predetermined needle for engaging the yarn 22 may be the first needle in the knitting section in which the yarn from the yarn feeder 20 is knitted. This first needle in the knitting section is the closest to the yarn feeder 20 of the needles in the knitting section, or, in other words, the needle nearest to the non-knitting section. The predetermined needle may also be the last needle in the non-knitting section from among the needles of the needle bed which does not take part in knitting. This last needle is the closest to the yarn feeder 20 of the needles in the non-knitting section, or, in other words, the needle nearest to the knitting section. Although the yarn 22 is preferably engaged by the last needle in the non-knitting section as described above, the yarn may alternatively be engaged by any needle positioned at an end portion of the non-knitting section adjacent the knitting section (except the last needle).

When the needle for engaging the yarn 22 is the first needle in the knitting section after the yarn 22 is caught by the needle, it is knitted in the knitting section. When the needle for engaging the yarn 22 is the last needle in the non-knitting section, the yarn 22 is removed from the last needle in the non-knitting section at an arbitrary time after knitting of the knitting section is started.

It is assumed in the following description that the amount of advancement of a needle for pushing down a yarn is determined such that the needles 16 on the front side which contribute to knitting are advanced to a tuck position, whereas the needles 18 on the rear side which do not contribute to knitting are advanced farther than a tuck position; for example, to a clearing position. Further, it is assumed that the distance between a needle in the non-knitting section which first starts advancement in order to push down a yarn 22 and the yarn feeder 20 then is sufficiently greater than the distance during ordinary knitting between an advancement of the needle and the position of the yarn feeder 20. Further, it is assumed that the needles 16 on the front side directly take part in knitting whereas the needles 18 on the rear side indirectly take part in knitting. In the present specification, the needle bed 12 to which the needles 16 on the front side belong is merely referred to as a needle bed which takes part in knitting whereas the needle bed 14 to which the needles 18 on the rear side belong is referred to as the needle bed which does not take part in knitting.

First Embodiment

Figure 5:
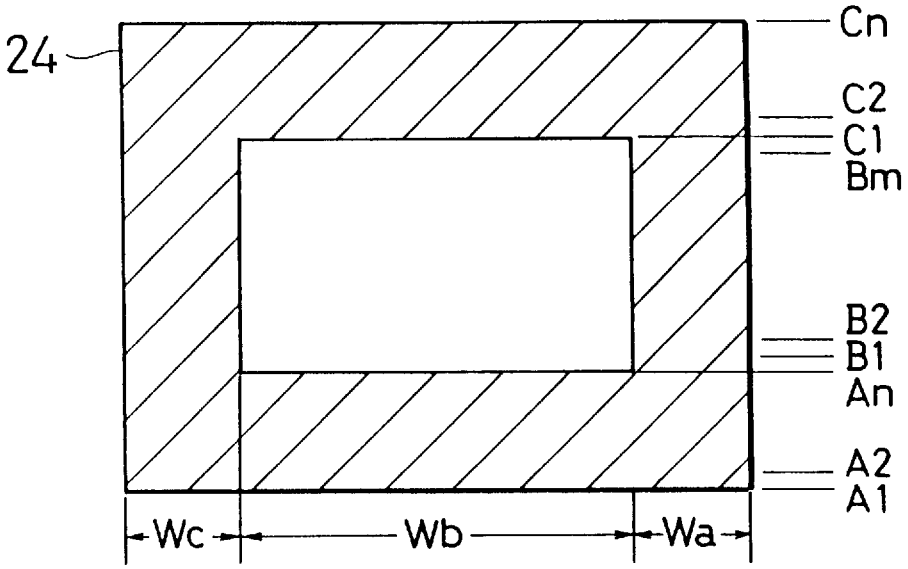
FIG. 5 is an explanatory view of a method of knitting an intarsia knit fabric.
Figure 6A:
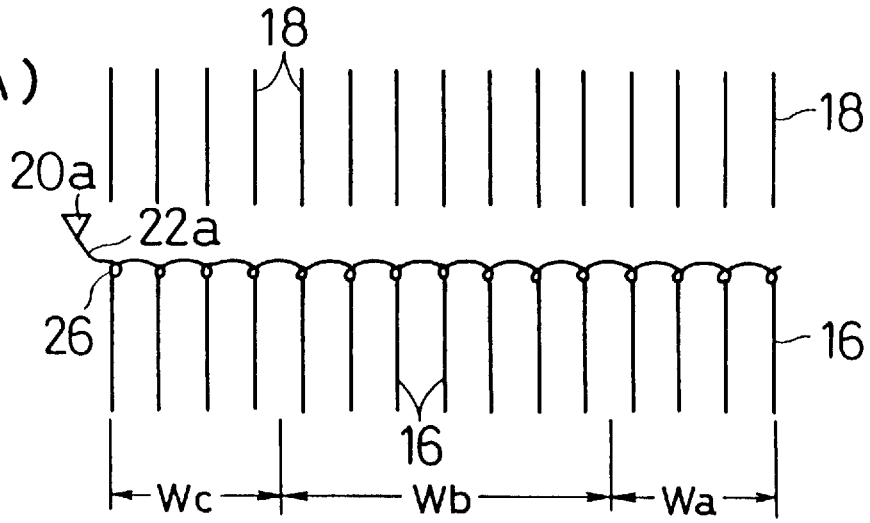
FIG. 6 is a view illustrating steps of a first embodiment of the present invention.
Figure 6B:
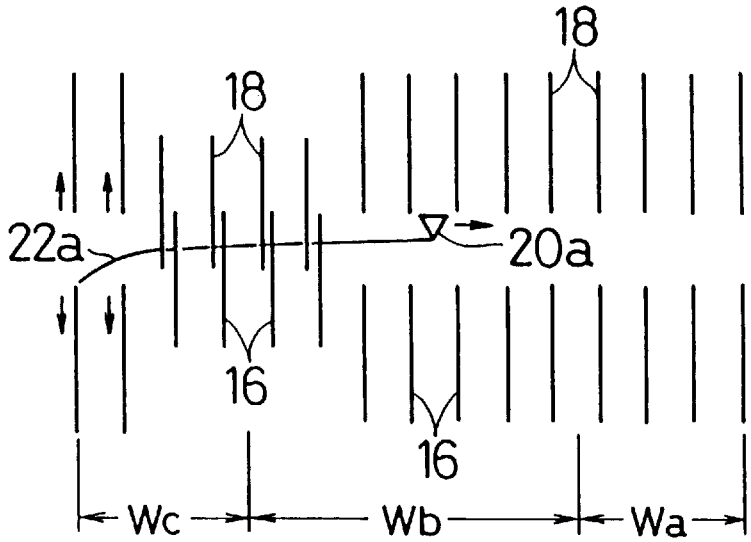
Figure 6C:
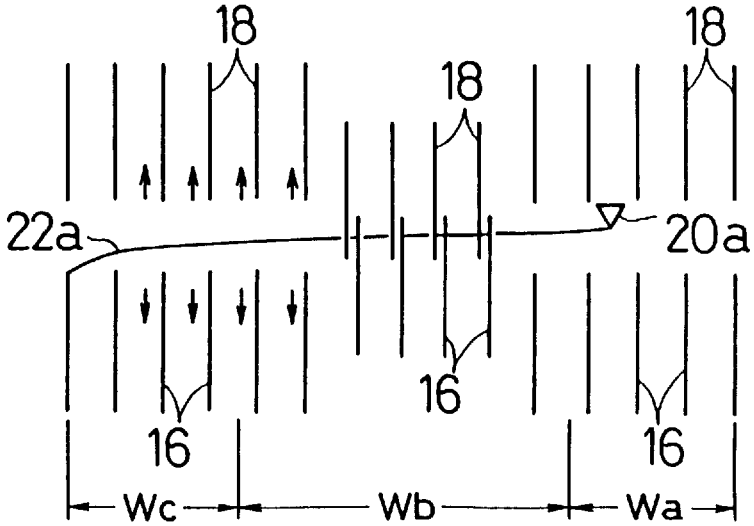

FIGS. 5, 6 and 7 show an embodiment wherein an intarsia knit fabric is knitted by a carriageless flat-knitting machine provided with three yarn feeders 20*a*, 20*b*, and 20*c*. In the first embodiment, in a course which includes a non-knitting section, all needles in the non-knitting section are advanced to hold down a transit yarn portion and then the needles are successively retracted in the same order as they were advanced so that the transit yarn portion is caught and confined by the first needle in a next knitting section.

In a knit pattern of FIG. 5, courses A1 to An and C1 to Cn are knitted with a black yarn 22*a* from the yarn feeder 20*a* in the entire sections Wa, Wb and Wc. Courses B1 to Bm are, in the section Wa, knitted with the yarn 22*a* from the yarn feeder 20*a*, in the section Wb, knitted with a white yarn 22*b* from the yarn feeder 20*b*, and in the section Wc, knitted with a black yarn 22*c* from the yarn feeder 20*c*. FIGS. 6 and 7 show the yarn 22*a* from the yarn feeder 20*a* in order to facilitate understanding.

The courses A1 to An are knitted by the following process.

The yarn feeders 20*a*, 20*b* and 20*c* are at predetermined standby positions; for example, at leftward positions as shown in FIGS. 6 and 7. In this state, the yarn feeder 20*a* is fed, that is, moved from the left to the right as shown in FIGS. 6 and 7 (depending upon a course, in the opposite direction). Predetermined selection of the needles 16 on the front side corresponding to the sections Wa, Wb and Wc are moved; that is, driven during the movement of the yarn feeder 20*a*. Consequently, the courses A1 to An are knitted in the entire sections Wa, Wb and Wc with the yarn 22*a*.

The direction of movement of the yarn feeder 20*a* is reversed for each course that the yarn feeder 20*a* is moved from the left to the right in the course A1, but from the right to the left in the next course A2. After knitting course An is completed, the yarn feeder 20*a* is returned to the predetermined standby position; for example, to the leftward position as shown in FIGS. 6 and 7.

The courses B1 to Bm are respectively knitted by the following process. When knitting course An is completed, the yarn feeders 20*a*, 20*b* and 20*c* stand by at the predetermined positions; for example, at the positions leftward of the knit fabric as shown in FIG. 6(A) in which the yarn feeder 20*a* is shown as representative.

First, in the state described above, the yarn feeder 20*a* is first moved from the position as shown in FIG. 6(A) to a position rightward of the knit fabric in the section Wa as shown in FIG. 6(B). In the courses B1 to Bn, the sections Wc and Wb are non-knitting sections in which the yarn 22*a* forms a transit yarn portion. In this instance, because yarn 22*a* is confined by the needle 16 at the left side in FIG. 6(A), the start point 26 of the yarn 22*a* is a portion confined by the needle 16.

Therefore, as shown in FIGS. 6(B) and (C), all of the needles 16 and 18 on the front and rear needle beds in the sections Wc and Wb are successively advanced beginning with the needles next to the start point 26 and then successively retracted in the same order as in the advancement in synchronism with the movement of the yarn feeder 20*a*. Consequently, more than one pair of the needles 16 and 18 on the front and rear needle beds near to the yarn feeder 20*a* are advanced. When the needles begin their advancement, the distance between the position of the yarn feeder 20*a* and the needles are set greater than the distance between the needles and the yarn feeder in ordinary knitting.

Figure 7A:
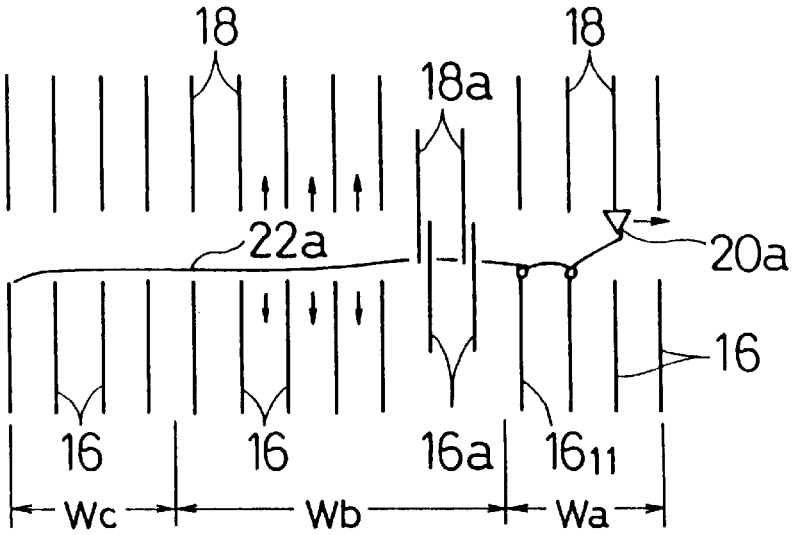
FIG. 7 is a view illustrating steps of the first embodiment following the steps of FIG. 6.

As shown in FIG. 7(A), when the yarn feeder 20*a* is further moved in the section Wa, the first needle 16 in the section Wa is moved to catch and confine the yarn 22*a*. In this instance, because the yarn 22*a* is pushed down by the last needles 16*a* and 18*a* in the section Wb, the yarn 22*a* is engaged with and confined by the needle $\mathbf{16}_{11}$.

Figure 7B:
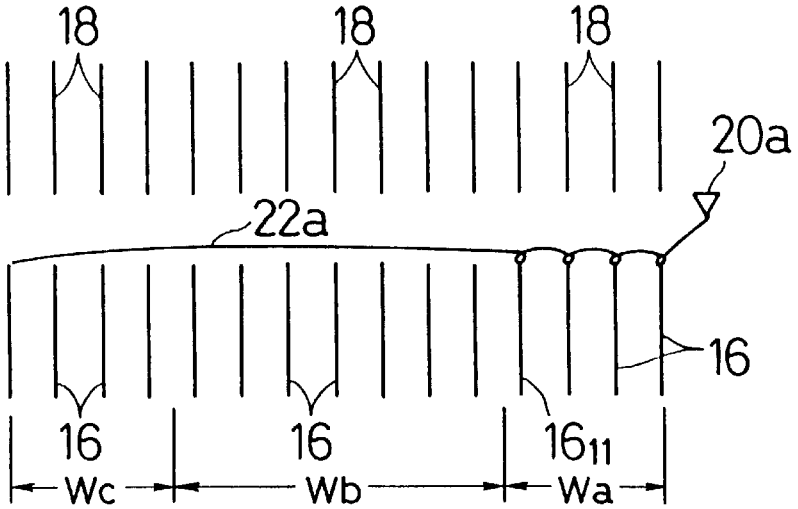

Thereafter, as the needles 16 in the section Wa are successively moved, knitting in section Wa with the yarn 22*a* is performed as shown in FIG. 7(B). All needles 16 which contribute to knitting in section Wa are moved to perform a knitting operation at an ordinary distance from the yarn feeder 20*a*.

Second, the yarn feeder 20*b* is moved rightwardly from the predetermined standby position. In the courses B1 to Bm, the section Wc is a non-knitting section in which the yarn 22*b* forms a transit yarn portion. Therefore, similarly as described above, all needles 16 and 18 on both of the needle beds in the section Wc, are successively advanced and then successively retracted in the same order that they were advanced in synchronism with the movement of the yarn feeder 20*b*.

When the yarn feeder 20*b* moves in the section Wb, the first needle in the section Wb is moved to confine the yarn 22*b*. Because the yarn 22*b* is held down by the last needle in the section Wc, the yarn 22*b* is engaged with and confined by the first needle in the section Wb with certainty. When the yarn feeder 20*b* moves in the section Wb, the needles 16 in the section Wb are successively driven so that knitting in the section Wb with the yarn 22*b* is performed.

Third, the yarn feeder 20*c* is moved rightwardly from the standby position. Thereupon, as the needles 16 in the section Wc are successively driven, knitting in the section Wc with the yarn 22*c* is performed.

Fourth, after one course is completed in such a manner as described above, the yarn feeders 20*a*, 20*b* and 20*c* are reciprocated simultaneously in the corresponding sections Wa, Wb and Wc, respectively, while the needles in the individual sections are operated in synchronism with the movements of the yarn feeders to continue knitting up to the course Bm.

The courses C1 to Cn are knitted by the following process.

When knitting of the course Bm is completed, the yarn feeders 20*a*, 20*b* and 20*c* are positioned leftwardly (or rightwardly) of the sections Wa, Wb and Wc, respectively. In this state, the yarn feeders 20*a*, 20*b* and 20*c* are first moved to the right side of the knit fabric and thereafter placed in standby. The yarn feeder 20*a* is then moved from the right to the left in FIG. 6 (depending upon a course, in the opposite direction), and the predetermined needles 16 corresponding to sections Wa, Wb and Wc are moved during the movement of the yarn feeder 20*a*. Consequently, the courses C1 to Cn are knitted in the entire sections Wa, Wb and Wc with yarn 22*a*.

Second Embodiment

The present invention can also be performed with a flat-knitting machine other than a carriageless type flat-knitting machine; for example, with a carriage type flat-knitting machine in which needles are moved by a cam. A method of knitting a knit fabric of the knit pattern shown in FIG. 5 on a carriage type flat-knitting machine is described below.

In the second embodiment, the courses A1 to An and C1 to Cn are knitted with the yarn 22*a* from the yarn feeder 20*a* in the entire sections Wa, Wb and Wc, and the courses B1 to Bm are knitted with the yarns 22*a*, 22*b* and 22*c* from the yarn feeders 20*a*, 20*b* and 20*c* in the sections Wa, Wb and Wc, respectively.

In each of the courses A1 to An, similarly as in the first embodiment, the carriage is moved together with the yarn feeder 20*a* from the right to the left or reversely with the yarn feeders 20*b* and 20*c* at predetermined standby positions on the left side of the knit fabric. During the movement of the carriage, as the predetermined needles 16 corresponding to the sections Wa, Wb and Wc are moved by the carriage, the courses A1 to An are knitted in sections Wa, Wb and Wc with the yarn 22*a*. After knitting of all of the courses A1 to An is completed, the carriage and the yarn feeder 20*a* are returned to the predetermined standby position on the left side of the knit fabric.

Subsequent to the knitting of courses A1 to An, courses B1 to Bm are knitted. The course B1 is knitted by the following process.

First, the carriage is moved in the rightward direction from the standby position to the left end of the section Wa with the yarn feeder 20*a* carried thereon. The carriage releases the yarn feeder 20*a* at the location whereafter it is returned to the left side of the knit fabric.

Second, the carriage is moved rightwardly. The carriage successively advances the needles of the front and rear needle beds in the sections Wc and Wb while it is moved rightwardly in the sections Wc and Wb. The advanced needles remain at the respective advanced positions.

Third, when the carriage is moved to the boundary location between the sections Wb and Wa, it carries the yarn feeder 20*a* standing by there and is further moved rightwardly in this state. While the carriage is moved in the section Wa, it moves the needles in the section Wa. Consequently, knitting in the section Wa is performed using the yarn 22*a*. When knitting in the section Wa is started, because the yarn 22*a* is held pushed down by the needles in section Wb, the yarn 22*a* is engaged with and confined by the first needle in the section Wa with certainty.

Fourth, the carriage releases the yarn feeder 20*a* at the right end of the knit fabric and is then moved leftwardly. The carriage retracts the needles in the advanced state when it passes sections Wb and Wc.

Fifth, the carriage carries the yarn feeders 20*b* at the left end of the knit fabric and is moved rightwardly in this state. The carriage then releases the yarn feeders 20*b* at the left end of the section Wb and thereafter it is returned to the left side of the knit fabric.

Sixth, the carriage is moved rightwardly and the needles on the front and rear needle beds in the section Wc are successively advanced by the carriage. The advanced needles remain at the advanced positions, and the yarn 22*b* is kept in a state in which it is pushed down by the needles in the section Wc.

Seventh, the carriage is moved to the boundary location between the sections Wc and Wb and carries the yarn feeder 20*b* standing by there, and then it is further moved rightwardly in this state. The carriage moves the needles in the section Wb while it is moved in the section Wb. Consequently, knitting in the section Wb is performed using the yarn 22*b* from the yarn feeder 20*b*. Also, upon the start of knitting in the section Wb, because the yarn 22*b* is held down by the needles in the section Wc, it is engaged with and confined by the first needle in the section Wb with certainty.

Eighth, the carriage releases the yarn feeder 20*b* on the left side of the section Wb and is then moved leftwardly in this state. The carriage retracts the needles in the advanced state when it passes the section Wc.

Thereafter, the carriage carries the yarn feeder 20*c* on the left side of the knit fabric and is moved rightwardly in this state. The carriage drives the needles in the section Wc while it is moved in the section Wc. Consequently, knitting in the section Wc is performed using the yarn 22*c* from the yarn feeder 20*c*. The carriage releases the yarn feeder 20*c* on the right side of the section Wc and then moves to the right end of the knit fabric.

Each of the other courses B2 to Bm is knitted successively in the sections Wa, Wb and Wc as the carriage carries, before it comes to each of the sections Wa Wb and Wc, a yarn feeder waiting at the end of the section and is moved to the other end of the section. The directions of movements of the carriage upon knitting of the courses B1 to Bm may be the same directions or may be reversed for each course. The courses C1 to Cn are knitted by the same technique as used for the courses A1 to An.

Third Embodiment

FIG. 8 shows an embodiment wherein the three-color intarsia knit fabric shown in FIG. 5, particularly the course, B1 to Bm, are knitted by a carriageless type flat-knitting machine provided with three yarn feeders 20*a*, 20*b* and 20*c*. In the third embodiment, upon starting of the course B1, which includes a non-knitting section, a transit yarn portion is caught by the last of the needles corresponding to the non-knitting section, that is, a needle nearest to a next knitting section. After the transit yarn portion is caught and confined by the needle, the needles advanced to hold down the transit yarn portion are retracted.

Figures 8A, 8B, 8C, 8D, 8E, 8F, 8G, 8H:
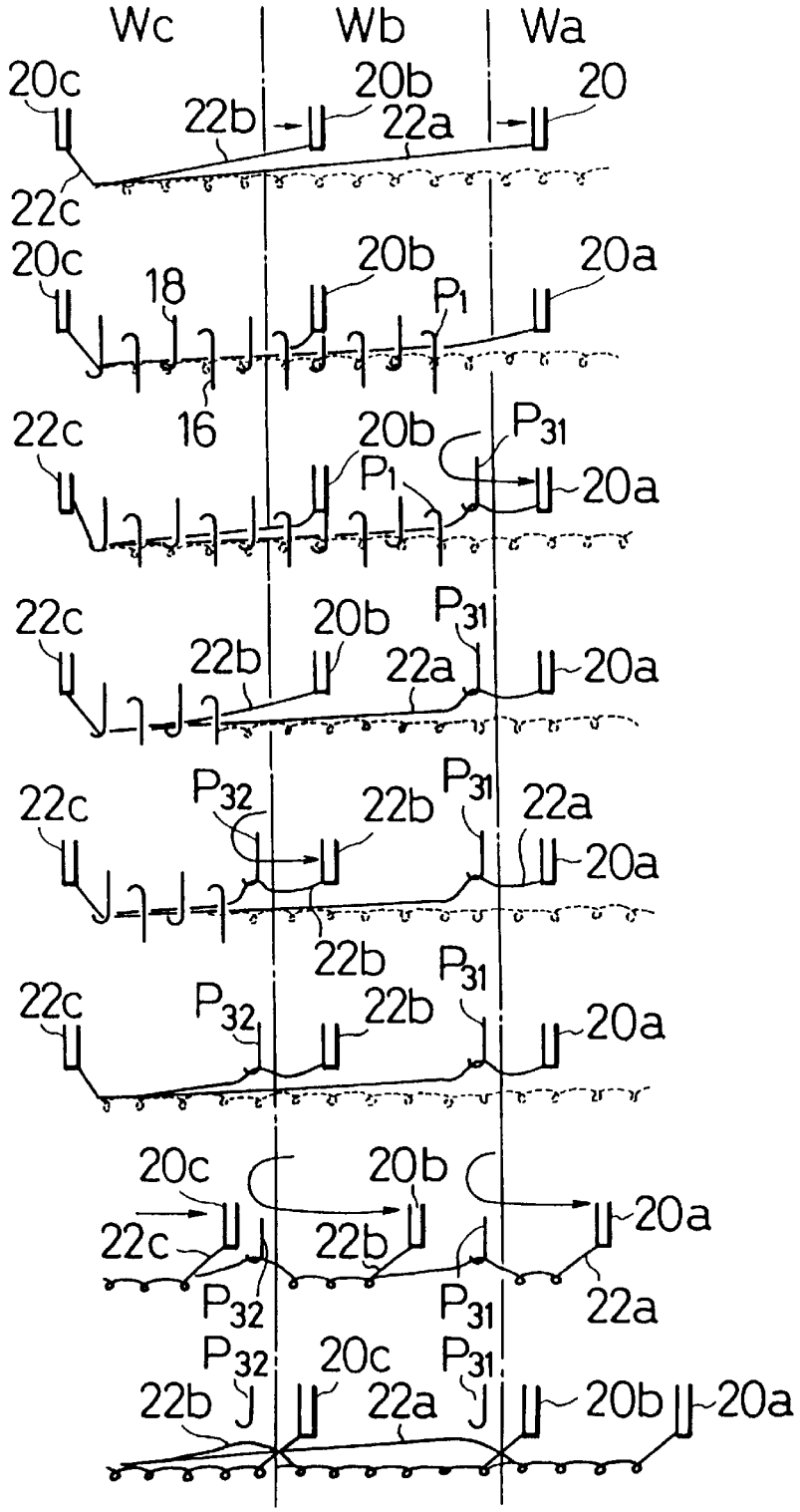
FIG. 8 is a view showing steps for explaining a third embodiment of the present invention.

First, in a state wherein the yarn feeder 20*c* stands by at a standby position leftward of the knit fabric as shown in FIG. 8(A), the yarn feeders 20*a* and 20*b* are moved from the respective standby positions leftward of the knit fabric to left end portions of the sections Wa and Wb, respectively.

Second, as shown in FIG. 8(B), all needles on the left side of the last needle P31 in the section Wb are advanced. Consequently, the yarn 22*a* from the yarn feeder 20*a* is pushed down by the needles in the sections Wc and Wb while the yarn 22*b* from the yarn feeders 20*b* is pushed down by the needles in the section Wc.

Third, the last needle $P_{31}$ in the section Wb is advanced, and the yarn feeder 20*a* is moved as indicated by the arrow as shown in FIG. 8(C). In particular, the yarn feeder 20*a* moves in the leftward direction from the position shown in FIG. 8(B) and passes the needle $P_{31}$, whereafter it moves in the rightward direction again. During the rightward movement of the yarn feeder 20*a*, the needle $P_{31}$ is advanced and retracted Consequently, the yarn 22*a* from the yarn feeder 20*a* is confined by the needle $P_{31}$. In this instance, since the yarn 22*a* is held down by the needles in the section Wb, it is confined with certainty by the needle $P_{31}$.

Fourth, all of the needles on the left side of the needle $P_{31}$ in the section Wb are retracted to release the yarn 22*a* as shown in FIG. 8(D). However, the yarn 22*a* is confined with certainty by the needle $P_{31}$ and held down by the needle $P_{31}$. Simultaneously, the last needle in the section Wc is retracted and releases the yarn 22*b*.

Fifth, the last needle $P_{32}$ in the section Wc is advanced as shown in FIG. 8(E) and the yarn feeder 20*b* is moved as indicated by the arrow. Consequently, the yarn 22*b* from the yarn feeder 20*b* is confined by the needle $P_{32}$. In this instance, because the yarn 22*b* is held down by the needles in the section Wc, the yarn 22*b* is confined with certainty by the needle $P_{32}$.

Sixth, all of the needles on the left side of the needle $P_{32}$ from among the needles in the section Wc are retracted and release the yarn 22*b* as shown in FIG. 8(F). However, the yarn 22*b* is confined with certainty by the needle $P_{32}$ and is held down by the needle $P_{32}$.

Seventh, the yarn feeders 20*a*, 20*b* and 20*c* are individually moved while the needles in the sections Wa, Wb and Wc are moved as shown in FIG. 8(G). Consequently, three courses are knitted in the sections Wa, Wb and Wc with the yarn 22*a*, 22*b*, and 22*c*, respectively. The states of movement of the yarn feeders in this instance are indicated by the arrows in FIG. 8(G).

Eighth, the needles $P_{31}$ and $P_{32}$ are retracted to release the yarns 22*a* and 22*b* from the needles $P_{31}$ and $P_{32}$, respectively as shown in FIG. 8(H). Thereafter, knitting is resumed.

Fourth Embodiment

FIGS. 9 and 10 show an embodiment wherein the three-color intarsia knit fabric shown in FIG. 5, particularly the courses B1 to Bm are knitted by a carriageless type flat-knitting machine provided with three yarn feeders 20*a*, 20*b* and 20*c*. In the fourth embodiment, the transit direction and the knitting direction in the first course are opposite to each other and the left and right positions at which a transit yarn is caught are reverse to those in the third embodiment.

Figure 9A:
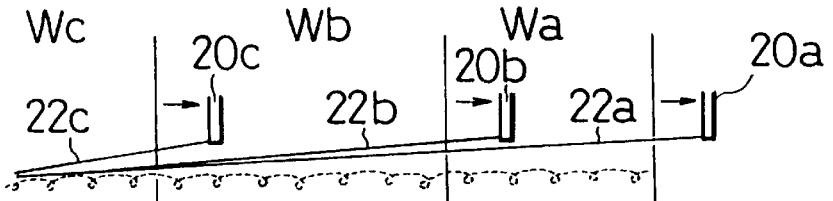
FIG. 9 is a view illustrating steps of a fourth embodiment of the present invention.

First, the yarn feeders 20*a*, 20*b* and 20*c* are moved from the standby positions leftwardly of the knit fabric to the right sides of the sections Wa, Wb and Wc, respectively, as shown in FIG. 9(A).

Figure 9B:
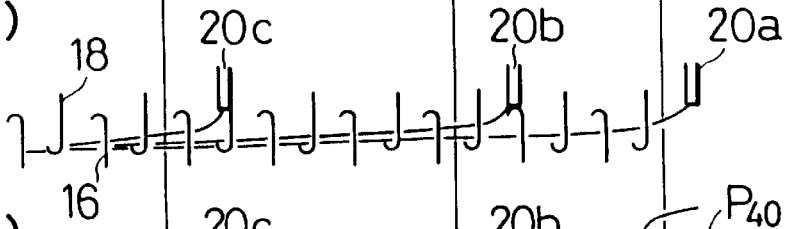

Second, all of the needles in the sections Wc, Wb and Wa are successively advanced beginning with needles in the sections Wc, Wb and Wa nearest to the starting point (in the example shown, the needles on the left side) as shown in FIG. 9(B). Consequently, the yarn 22*a* from the yarn feeder 20*a* is pushed down by the needles in the sections Wc, Wb and Wa, the yarn 22*b* from the yarn feeder 20*b* is pushed down by the needles in the sections Wc and Wb, and the yarn 22*c* from the yarn feeder 20*c* is pushed down by the needles in the section Wc.

Figure 9C:
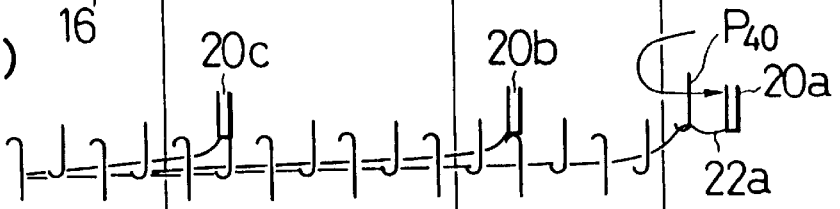

Third, an empty needle $P_{40}$ adjacent to the right side of the section Wa is advanced as shown in FIG. 9(C) and the yarn feeder 20*a* is moved as indicated by the arrow. Consequently, the yarn 22*a* from the yarn feeder 20*a* is engaged with and confined by the needle $P_{40}$. In this instance, since the yarn 22*a* is held down by the needles in the section Wa, the yarn 22*a* is confined with certainty by needle $P_{40}$.

Figure 9D:
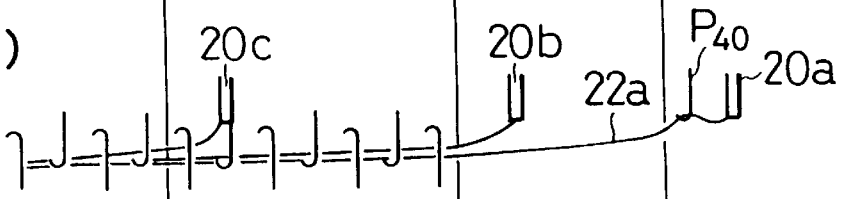

Fourth, all of the needles in the section Wa are retracted to release the yarn 22*a* as shown in FIG. 9(D). However, the yarn 22*a* remains confined with certainty by the needle $P_{40}$ and is held down by the needle $P_{40}$.

Figure 9E:
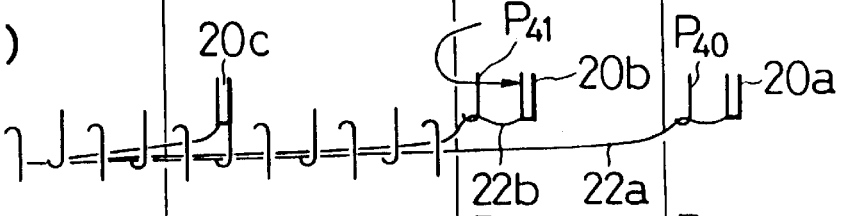

Fifth, a left end needle $P_{41}$ in the section Wa is advanced as shown in FIG. 9(E) and the yarn feeder 20*b* is moved as indicated by the arrow. Consequently, the yarn 22*b* from the yarn feeder 20*b* is engaged with and confined by the needle $P_{41}$. In this instance, since the yarn 22*b* remains held down by the needles in the section Wb, it is confined with certainty by the needle $P_{41}$.

Figure 9F:
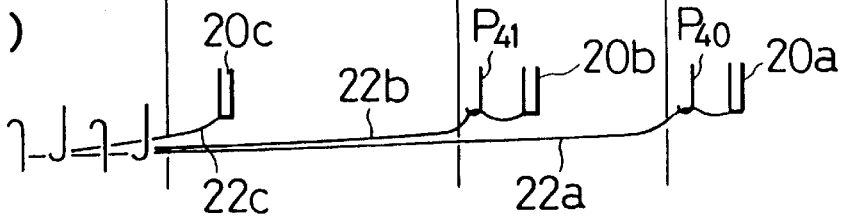

Sixth, all of the needles in the section Wb are retracted to release the yarn 22*b* as shown in FIG. 9(F). However, the yarn 22*b* remains confined by the needle $P_{41}$ and is held down by the needle $P_{41}$.

Seventh, a left end needle $P_{42}$ in the section Wb is advanced as shown in FIG. 10 (A) and the yarn feeder 20*c* is moved as indicated by the arrow. Consequently, the yarn 22*c* from the yarn feeder 20*c* is engaged with and confined by the needle $P_{42}$. In this instance, since the yarn 22*c* remains held down by the needles in the section Wc, it is confined with certainty by the needle $P_{42}$.

Eighth, all of the needles in the section Wc are retracted to release the yarn 22*c* as shown in FIG. 10 (B) However, the yarn 22*c* remains confined by the needle $P_{42}$ and accordingly, it is held down by the needle $P_{42}$.

Figures 10A, 10B, 10C, 10D, 10E:
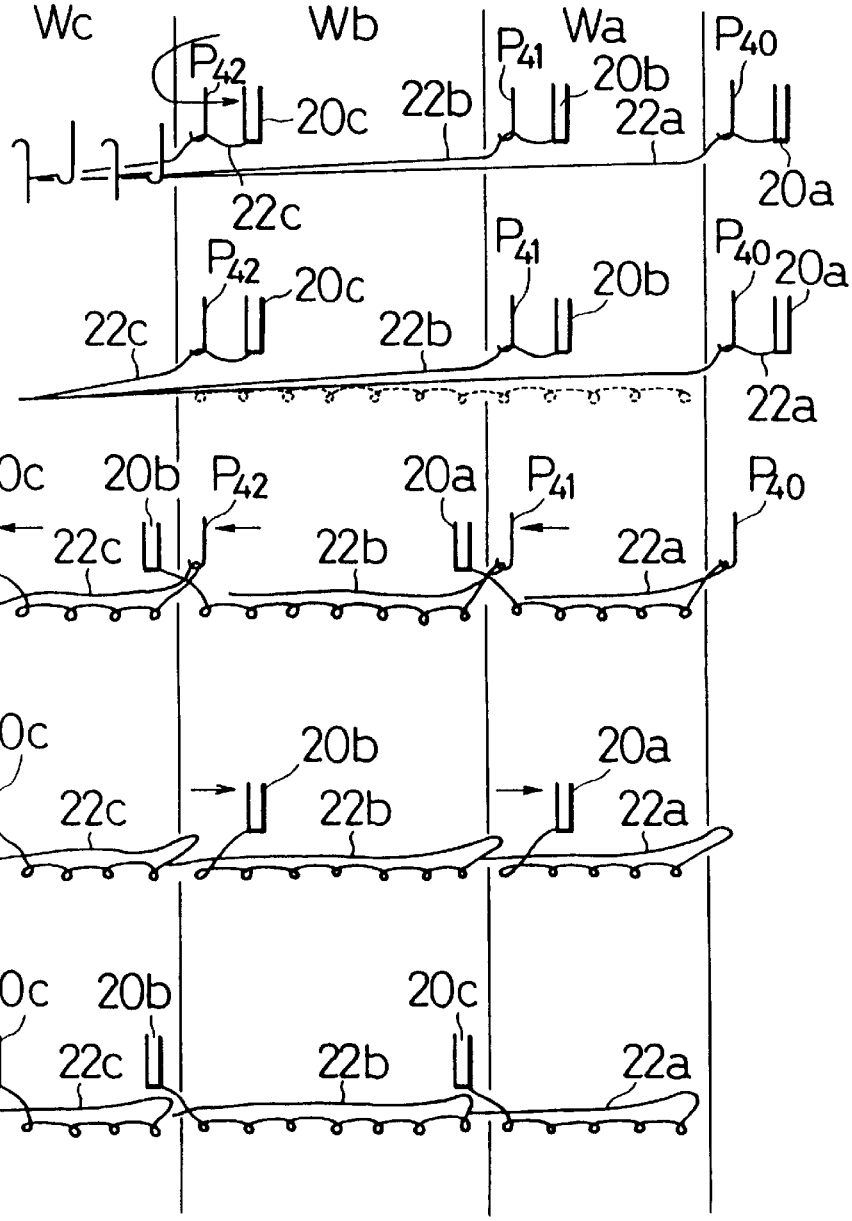
FIG. 10 is a view illustrating steps of the fourth embodiment of the present invention.

Ninth, the yarn feeders 20*a,* 20*b* and 20*c* are moved leftwardly to the outside of the sections Wa, Wb and Wc, respectively, as shown in FIG. 10(C) and the needles in the sections Wa, Wb and Wc are driven. Consequently, the sections Wa, Wb and Wc are knitted with the yarns 22*a,* 22*b* and 22*c,* respectively. In this instance, since the yarns 22*a,* 22*b* and 22*c* remain held down by the needles $P_{40}$, $P_{41}$ and $P_{42}$, respectively, they are caught with certainty by the needles in the corresponding sections.

After the yarn feeders 20*a,* 20*b* and 20*c* are moved to the outsides of the sections Wa, Wb and Wc respectively, they are subsequently moved from the right to the left in the sections Wa, Wb and Wc. During the movements, the needles in the sections Wa, Wb and Wc are driven to knit. Consequently, three courses are knitted in each of the sections Wa, Wb and Wc.

Tenth, the needles $P_{49}$, $P_{41}$ and $P_{42}$ are retracted as shown in FIG. 10(D) to remove the yarns 22*a* and 22*b* from the needles $P_{40}$, $P_{41}$ and $P_{42}$, respectively.

Eleventh, the yarn feeders 20*a,* 20*b* and 20*c* are returned to the respective original positions as shown in FIG. 10(E). Thereafter, knitting is resumed.

Fifth Embodiment

Figure 11A:
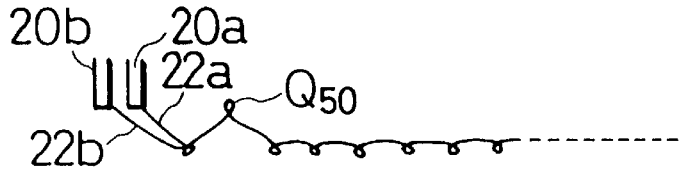
FIG. 11 is a view illustrating steps of a fifth embodiment of the present invention.
Figure 11B:
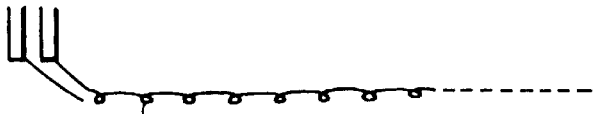
Figure 11C:
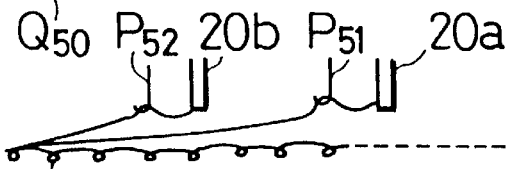
Figure 11D:
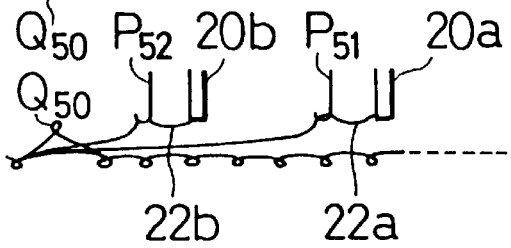
Figure 12:
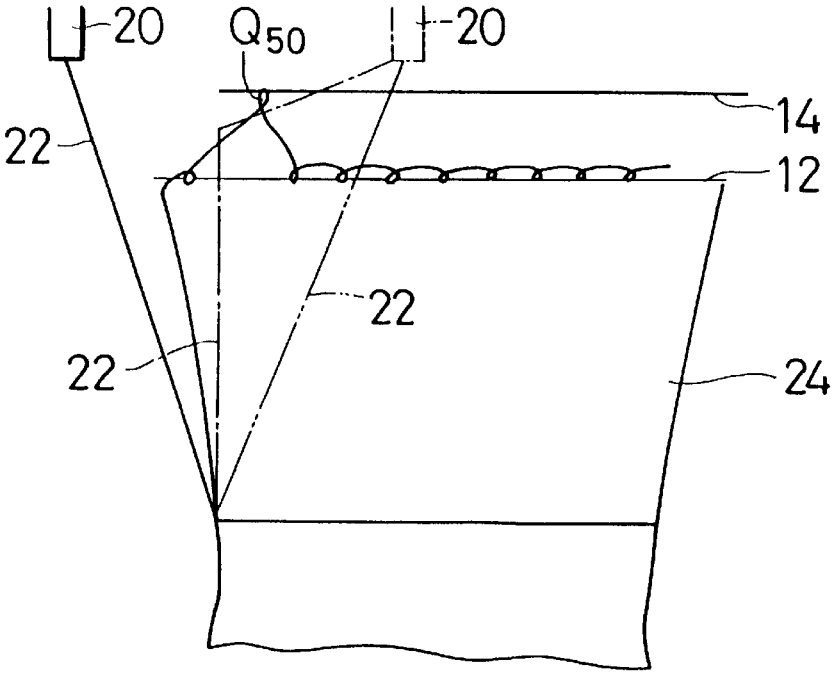
FIG. 12 is a view illustrating a relationship between loops and a yarn in the fifth embodiment.

While the embodiments described above relate to a method of knitting an intarsia knit fabric based on a plain stitch, the present invention can be applied also to a method of knitting other multi-color single knit fabrics.

Where a rib structure is present at one end or both ends of a knit fabric in its widthwise direction, if a yarn 22 from a yarn feeder 20 is connected to an end of a knit fabric 24 as shown in FIG. 12, the yarn 22 from the yarn feeder 20 is caught by a loop $Q_{50}$ in the rib knit portion and the yarn 22 becomes so high as indicated by an alternate long and short dashes line that often the yarn 22 cannot be caught by the knitting needles. In such a case, by using the following knitting process, the yarn 22 from the yarn feeder 20 is held down by the loop $Q_{50}$ in the rib knit portion as indicated by an alternate long and two short dashes line in FIG. 11 and the yarn 22 is lowered.

First, when the needles on the front and rear needle beds 12 and 14 and loop immediately before a transit yarn, as shown in FIG. 11(A) and FIG. 12, the two loops $Q_{50}$ of the rib structure confined by the needle bed 14 on the rear side are transferred to a corresponding needle bed 14 on the front side as shown in FIG. 11(B).

Second, the yarn feeders 20*a* and 20*b* and the needles $P_{51}$ and $P_{52}$ are moved as shown in FIG. 11(C)) so as to perform transit yarn processing wherein the yarns 22*a* and 22*b* are engaged with and confined by the needles $P_{51}$ and $P_{52}$ on the needle bed 14 on the rear side as in the embodiments described above.

Third, as shown in FIG. 11(D), the two loops $Q_{50}$ of the rib structure transferred to the needle on the needle bed 12 on the front side are returned to the original needle on the needle bed 14 on the rear side. Thereafter, knitting is started based on the procedure employed in the embodiments described above, particularly in the third embodiment. Consequently, as indicated by an alternate long and two short dashes line in FIG. 12., the yarns 22*a* and 22*b* are held down by the two loops $Q_{50}$ of the rib structure thus returned, and the yarns 22*a* and 22*b* are held low.

Sixth Embodiment

FIG. 13 illustrates an embodiment of a knitting method wherein in order to end knitting of an intarsia knit fabric based only on a plain stitch on a carriageless type flat-knitting machine provided with three yarn feeders 20*a,* 20*b* and 20*c,* transit yarn processing is performed when a yarn feeder goes out of the knit fabric. In FIG. 13, the left end and the right end of the knit fabric are denoted by reference numerals $\mathbf{24}_1$ and $\mathbf{24}_2$, respectively.

Figures 13A, 13B, 13C, 13D, 13E, 13F:
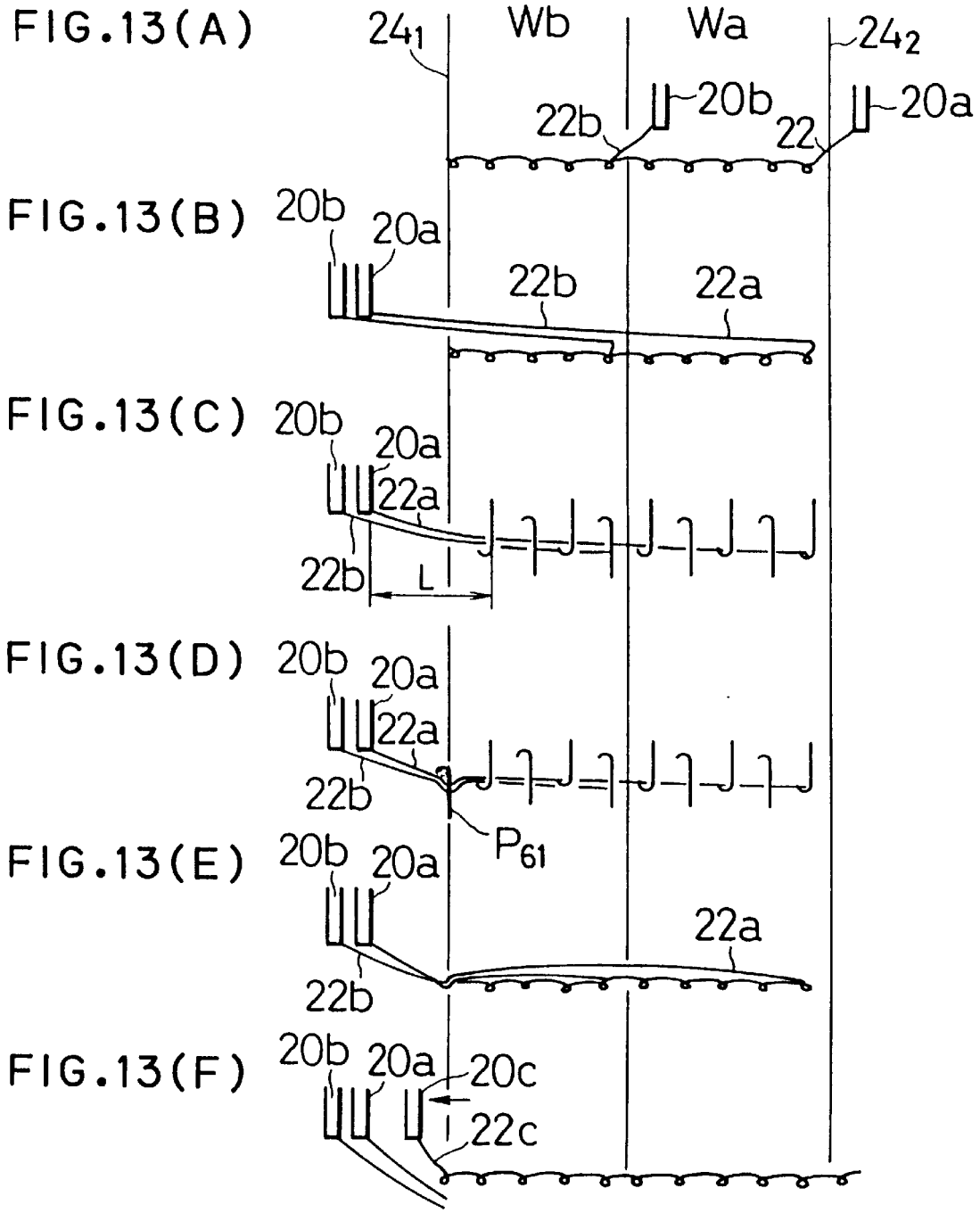
FIG. 13 is a view illustrating steps of a sixth embodiment of the present invention.

First, the yarn feeders 20*a* and 20*b* are moved back and forth in the sections Wa and Wb, respectively, as shown in FIG. 13(A) while the needles in the sections Wa and Wb are knitted with the yarn 22*a* and 22*b* from the yarn feeders 20*a* and 20*b,* respectively.

Second, after completion of knitting of the intarsia pattern portion, the yarn feeders 20*a* and 20*b* are moved to the outside on the left side of the knit fabric as shown in FIG. 13(B). Simultaneously or subsequently, all of the needles in the sections Wa and Wb other than the leftmost end needle $P_{61}$ in the section Wb are successively advanced beginning with the rightmost needle in order to push down a transit yarn portion or portions as shown in FIG. 13(C).

Third, the leftmost end needle $P_{61}$ in the section Wb is driven to knit the two transit yarn portions in the knit fabric by a tuck stitch as shown in FIG. 13 (D). In this instance, because the yarns 22*a* and 22*b* are held down low by the needles in the section Wb, the yarns 22*a* and 22*b* are knitted into tuck stitches with certainty by the leftmost end needle $P_{61}$.

Fourth, all of the needles in the sections Wa and Wb are retracted as shown in FIG. 13(E) whereafter the yarn feeder 20*c* is moved from the right to the left as shown in FIG. 13(F) while the needles in the sections Wa and Wb are driven for knitting. Consequently, both of the sections Wa and Wb are knitted with the yarn 22*c* form the yarn feeder 20*c*.

While all of the third, fourth, fifth and sixth embodiments employ a carriageless type flat-knitting machine, the present invention can be performed also by a carriage type flat-knitting machine by moving the yarn feeders and the needles by means of a carriage.

Figure 15:
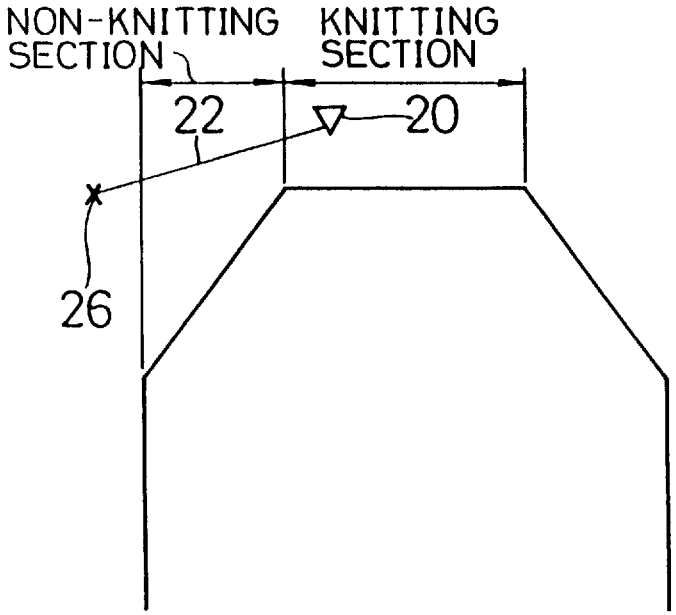
FIG. 15 is a view illustrating a method of knitting another single knit fabric in accordance with the present invention.

While all of the first to eighth embodiments described above relate to a method of knitting a multi-color single knit fabric on which a transit yarn portion appears, the present invention can be applied also to a knit fabric whose knitting width gradually increases as shown in FIG. 15. In particular, when the first course is knitted, a yarn from a yarn feeder is not knitted in a range from a portion thereof gripped by a gripping member to a knitting section. Consequently, the yarn 22 from the yarn feeder 20 forms a transit yarn portion in the range. In order to knit the aforesaid single knit fabric, the yarn 22 from the yarn feeder 20 should be engaged with the first needle in the knitting section after a plurality of needles corresponding to the non-knitting section are successively advanced beginning with the needle nearest to an end portion (start point 26) of the transit yarn portion. Thereafter, the needles in the non-knitting section previously advanced are retracted.

Embodiment of Control Unit

Figure 14:
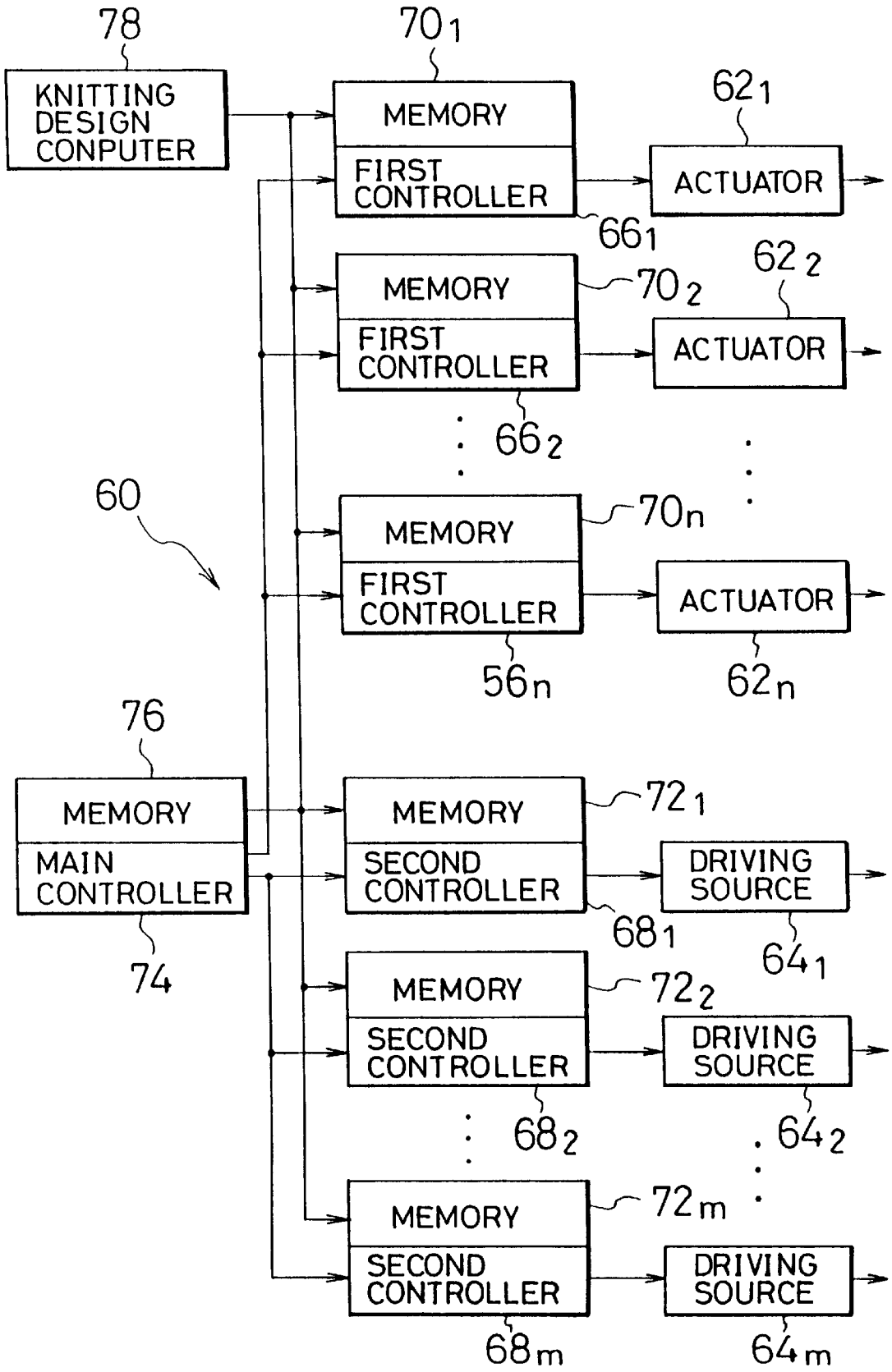
FIG. 14 is a block diagram of an electric circuit showing an embodiment of a control unit.

FIG. 14 shows an embodiment of a control unit 60 used for a carriageless type flat-knitting machine on which the knitting method described above is performed.

The carriageless type flat-knitting machine includes a plurality of actuators $\mathbf{62}_1$ to $\mathbf{62}_n$ for individually moving the corresponding needles back and fourth, and a plurality of driving sources $\mathbf{64}_1$ to $\mathbf{64}_m$ for individually and transversely reciprocating the corresponding yarn feeders. A DC linear motor is employed for the actuators. An electric motor with a speed reducer is used for the driving sources.

The control unit 60 includes a plurality of first controllers $\mathbf{66}_1$ to $\mathbf{66}_n$ for individually controlling the movements and the positions of the corresponding actuators, and a plurality of second controllers $\mathbf{68}_1$ to $\mathbf{68}_m$ for individually controlling the rotations and positions of the corresponding driving sources. The first and second controllers, $\mathbf{66}_1$ to $\mathbf{66}_n$ and $\mathbf{68}_1$ to $\mathbf{68}_m$, are individually provided by numbers equal to the numbers of the corresponding actuators and yarn feeders, respectively.

The first controllers $\mathbf{66}_1$ to $\mathbf{66}_n$ include memories $\mathbf{70}_1$ to $\mathbf{70}_n$ for storing operations of the first controllers based on a predetermined knitting plan, respectively. Similarly, the second controllers, $\mathbf{68}_1$ to $\mathbf{68}_m$ include memories $\mathbf{72}_1$ tp $\mathbf{72}_m$ for storing operations of the second controllers based on the predetermined knitting plan.

The first and second controllers, $\mathbf{66}_1$ to $\mathbf{66}_n$ and $\mathbf{68}_1$ to $\mathbf{68}_m$ are connected to a common main controller 74 for providing timing signals of operations to the first controllers. The first controllers control the positions of the needles in synchronism with the operations of the second controllers. The second controllers control the positions of the yarn feeders. The main controller 74 is connected to the memory 76 in which operations of the main controller 74 based on the predetermined knitting plan are stored.

Data to be stored in the memories $\mathbf{70}_1$ to $\mathbf{70}_n$ and $\mathbf{72}_1$ to $\mathbf{72}_m$ are data based on the predetermined knitting plan and are produced by a knitting design computer 78 based on the predetermined knitting plan. The data produced by the knitting design computer 78 are either supplied directly to the individual memories by communication means such as a data communication line or supplied indirectly into the individual memories via some other communication means such as a tape, disk or bubble memory.

The data stored in the memories of the first controllers, $\mathbf{66}_1$ to $\mathbf{66}_n$ are position data of the corresponding actuators and hence the corresponding needles, knit pattern data and some other necessary data for individual knitting courses.

The data stored in the memories of the second controllers, $\mathbf{68}_1$ to $\mathbf{68}_m$, are data of the corresponding yarn supply units and hence the widths and moving speeds of reciprocating motions of the yarn feeders and so forth for individual knitting courses and some other necessary data. The data stored in the memory 76 of the main controller 74 are data in accordance with which selection of a yarn supply unit to be fed and selection of needles to be operated depending upon the positions of the yarn supply units are performed for each knitting course and some other necessary data.

The first and second controllers, $\mathbf{66}_1$ to $\mathbf{66}_n$, and $\mathbf{68}_1$ and $\mathbf{68}_m$ operate the corresponding actuators and driving sources based on the data in the corresponding memories under the control of the main controller 74. Consequently, the flat-knitting machine knits a multi-color single knit fabric having a predetermined knit pattern changing the feeding order of the plurality of yarn feeders in such a manner as described above.

What is claimed is:

1. A method of knitting a single knit fabric in which yarn from a yarn feeder is not knitted comprising the steps of:

successively advancing a plurality of needles in a non-knitting section, providing each needle with an arcuate portion, contacting the advanced needles at the arcuate portions with the yarn on one side of the yarn feeder, lowering the yarn below the advanced needles to form a transit portion of the yarn, forming a starting point for the yarn portion located at a position of a first advanced needle; and engaging the yarn by another needle closer to the yarn feeder than the advanced needles.

2. A method of knitting a single knit fabric according to claim 1, further comprising positioning the advanced needles on a needle bed which takes part in knitting, on a needle bed which does not take part in knitting, or both.

3. A method of knitting a single knit fabric according to claim 1, further comprising providing the advanced needles to include all of the needles in the non-knitting section, a plurality of the needles in the non-knitting section or a plurality of the needles in the non-knitting section distal from the starting point of the transit yarn portion.

4. A method of knitting a single knit fabric according to claim 1, wherein the other needle is the first needle of a knitting section in which the yarn from the yarn feeder is knitted or the last needle in the non-knitting section, the last needle being a needle positioned on a needle bed which does not take part in knitting.

5. A method of knitting a single knit fabric as claimed in claim 2, wherein the advanced needles include all of the needles in the non-knitting section or a plurality of the needles in the non-knitting section or a plurality of the needles in the non-knitting section distal from the starting point of the transit yarn portion.

6. A method of knitting a single knit fabric according to claim 2, wherein the other needle is the first needle of a knitting section in which the yarn from the yarn feeder is knitted or the last needle in the non-knitting section, the last needle being a needle positioned on a needle bed which does not take part in knitting.

7. A method of knitting a single knit fabric according to claim 3, wherein the other needle is the first needle of a knitting section in which the yarn from the yarn feeder is knitted or the last needle in the non-knitting section, the last needle being a needle positioned on a needle bed which does not take part in knitting.

* * * * *

UNITED STATES PATENT AND TRADEMARK OFFICE

CERTIFICATE OF CORRECTION

PATENT NO. : 5,819,558

DATED : October 13, 1998

INVENTOR(S) : Yujiro Takegawa et al.

It is certified that error appears in the above-identified patent and that said Letters Patent is hereby corrected as shown below:

Column 1 Line 57 between "the" and "operation" delete colon --:--.

Column 9 Line 61 after "retracted" insert period --.--.

Column 11 Line 36 "$P_{49}$" should read --$P_{40}$--.

Column 14 Line 33 Claim 3 "providing" should read --positioning--.

Signed and Sealed this

Twenty-fifth Day of May, 1999

*Attest:*

*Attesting Officer*

Q. TODD DICKINSON

*Acting Commissioner of Patents and Trademarks*